United States Patent [19]

Schonberger

[11] Patent Number: 4,480,760

[45] Date of Patent: Nov. 6, 1984

[54] TAMPER VISIBLE INDICATOR FOR CONTAINER LID

[76] Inventor: Milton Schonberger, 1 Century Tower, Fort Lee, N.J. 07024

[21] Appl. No.: 484,636

[22] Filed: Apr. 13, 1983

Related U.S. Application Data

[63] Continuation-in-part of Ser. No. 451,794, Dec. 21, 1982, abandoned.

[51] Int. Cl.[3] ..... B65D 55/02

[52] U.S. Cl. ..... 215/230

[58] Field of Search ..... 215/230, 365, 366

[56] References Cited

U.S. PATENT DOCUMENTS

| | | | |
|---|---|---|---|
| 1,066,872 | 7/1913 | Wilson . | |
| 2,939,597 | 6/1960 | Greene | 215/230 |
| 3,896,965 | 7/1975 | Cornell | 220/359 |
| 3,923,198 | 12/1975 | Brochman | 220/359 |
| 4,197,947 | 4/1980 | Zaidi | 206/807 |
| 4,266,687 | 5/1981 | Cummings | 215/232 X |
| 4,424,911 | 1/1984 | Resnick | 215/365 |

*Primary Examiner*—Donald F. Norton

*Attorney, Agent, or Firm*—Ostrolenk, Faber, Gerb & Soffer

[57] ABSTRACT

A disc or other insert placed on the neck of a container provides a visible indication that the lid of the container had been removed or tampered with. An indicator is provided on the disc surfaces and it changes its character to provide its indication upon removal of the lid. For example, the indicator might be microencapsulated, and the microcapsules would be broken upon separation of the discs. Means in the lid rub the indicator for activating it. In a variant of this, the lid is transparent and permits viewing of the indicator through the lid. The disc may have a layer under the indicator for compensating for manufacturing tolerances.

52 Claims, 21 Drawing Figures

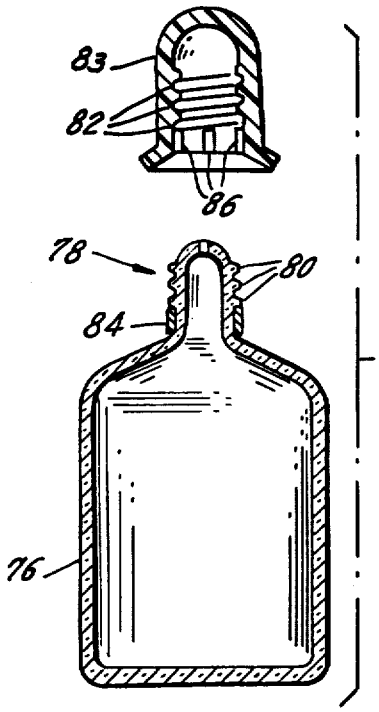
FIG. 11
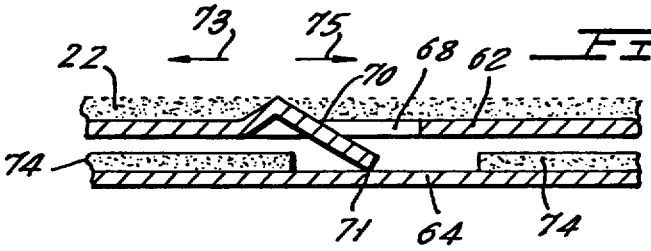
FIG. 8
FIG. 9
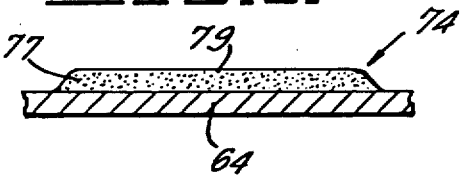
FIG. 10
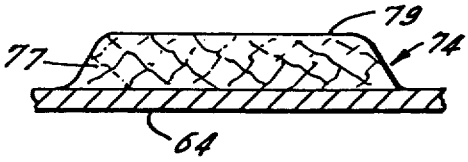

FIG. 16
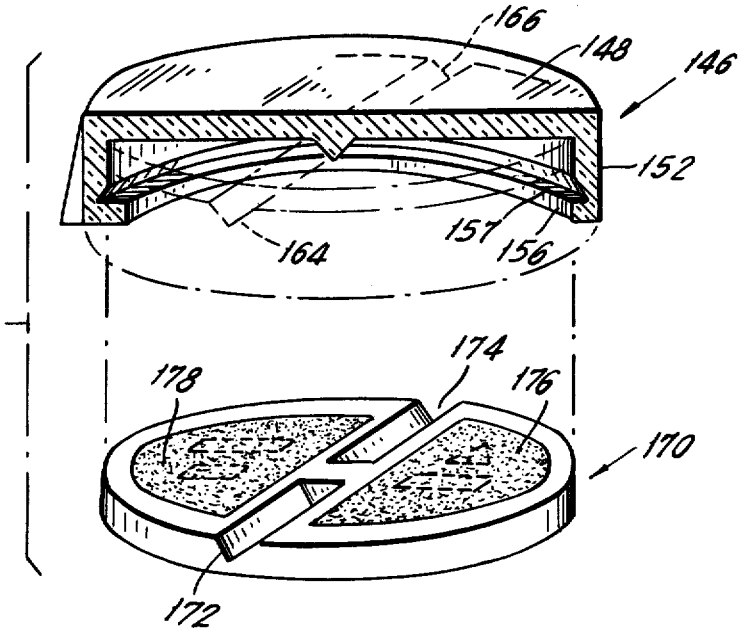
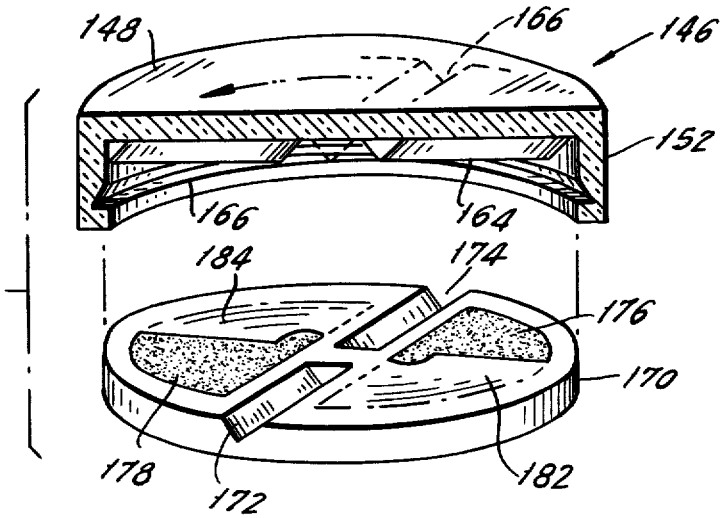
FIG. 17

FIG. 18
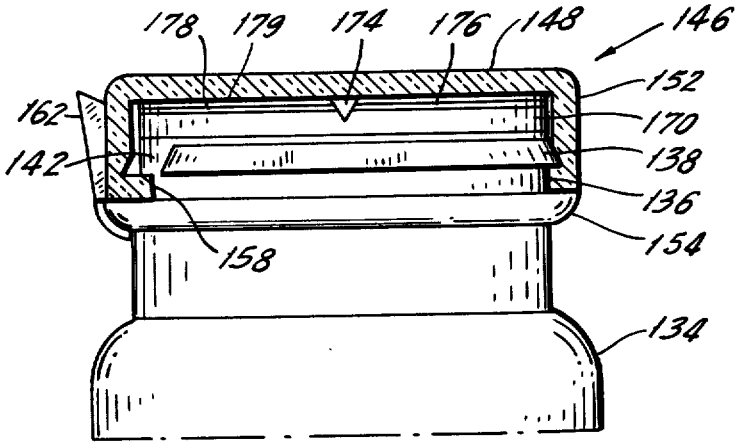
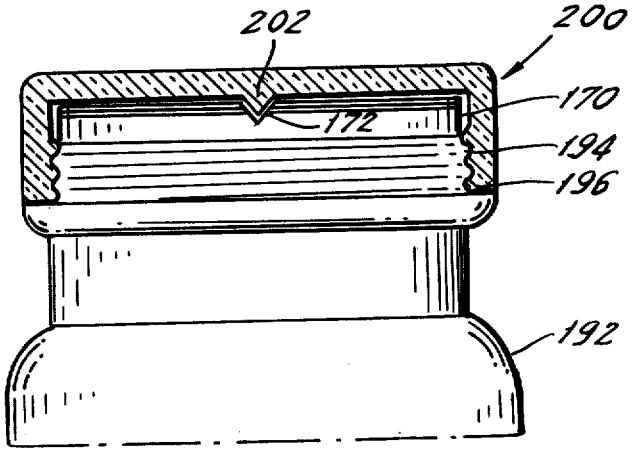
FIG. 19

TAMPER VISIBLE INDICATOR FOR CONTAINER LID

CROSS-REFERENCE TO RELATED APPLICATION

This is a continuation-in-part of application Ser. No. 451,794, filed Dec. 21, 1982, now abondoned.

BACKGROUND OF THE INVENTION

The present invention relates to a tamper evident, and particularly tamper visible indicator for the lid or cover of a container to provide an indication to the user that the container lid had been previously removed or tampered with.

It has become increasingly desirable to enable a person who has acquired a container with a removable cover or lid to determine whether the container lid or cover had been previously removed from the container or been tampered with.

Various techniques are currently used to enable a person to determine if a container lid had been previously removed or tampered with. A seal is applied to the container lid, which is broken when the container lid is removed or removal has begun. In the alternative, the entire container is wrapped in a sealed covering, e.g. in plastic shrink wrap, or a so-called blister pack, or the like. A broken seal or a damaged covering will indicate that the container lid might previously have been removed.

Various sealing tapes or covering edge seals, and the like, include indicators which change condition when they are removed or tampered with. See U.S. Pat. Nos. 4,266,687; 3,896,965; 3,923,198; and 4,197,947. These indicators and many other available alternatives are not foolproof because ways are inexpensively and readily available permitting someone to reapply a seal or other indicator means, to rewrap or reseal an entire container, etc.

Another problem experienced with known lid removal indicators is that their application to a container requires an additional step after the container has been filled. This inconveniences or makes more expensive the container filling and closing operation, e.g. applying a seal to the lid after the container is closed, wrapping the entire container, etc.

SUMMARY OF THE INVENTION

Accordingly, it is the primary object of the invention to indicate that the lid or cover of the container has been removed or that its removal has been attempted.

It is another object of the invention to provide such an indicator which cannot be easily circumvented or easily replaced.

It is a further object of the invention to provide such an indicator which will minimize additional steps required in loading and closing a container having such indicator.

Yet another object of the invention is to provide such an indicator which becomes an integral part of the container, and particularly its lid or cover.

The present invention comprises an indicator which is disposed beneath the container lid or cover. It is installed at any time between the initial fabrication of the lid and the application of the lid to the opening into the container. The indicator is not activated either before the lid is placed on the container or while the lid is on the container. The indicator is first activated when the lid is removed from the container for the first time or when such lid removal is attempted. The activation of the indicator causes a human perceptible characteristic of the indicator (e.g., the color or size) to change, perhaps instantly or perhaps over a several second interval. Depending upon which embodiment of the invention is involved, the activation of the indicator will be observable by the first person who removes the lid or the first person who attempts the removal. If the person who removes or attempts to remove the lid of the container finds that the change in characteristic has already taken place, he may infer that the lid had previously been removed or been tampered with. If the change never takes place, he may infer that the indicator is defective or has been tampered with. If the change takes place while he observes it happening, he may infer that he is the first to remove or attempt to remove the lid.

One preferred form of indicator according to the invention is defined on an insert installed in the lid or cover before it is applied to the container. The insert comprises upper and separate lower disc means which are initially secured together. Means adhere the insert in the lid of the container. In particular, an adhesive layer on the top surface of the upper disc of the insert adheres the insert inside the top of the lid of the container. The lower surface of the lower disc is provided with its own adhesive layer such that when the lid with the installed insert is applied to the open neck of the container, the bottom of the lower disc is adhered to the neck of the container. When the lid is tightened on the container by being snapped into place, by being screwed onto the neck of the container, etc., the upper disc is secured in the lid while the lower disc is secured on the container. The securing means fastening the two discs together exerts less securing force than the means adhering both of the upper and lower discs to the lid and container, respectively. When the lid is subsequently separated from the container, the upper and lower discs respectively remain with the lid and container. For the first time, this exposes the facing surfaces of the upper and lower discs. The indicator is disposed between the upper and lower discs and is activated by the initial separation of the upper and lower discs. The act of removing the lid and simply separating the discs may activate the indicator. Alternatively, the lid removal may rub the discs together and this rubbing may activate the indicator.

The manner of holding the discs together may preclude entry of air between them, entry of light between them, or exposure to any selected condition in the ambient environment, etc. The facing surfaces of one or both of the discs may be coated with an indicator that responds to exposure to air or light to change some characteristic, such as the color of the exposed surface. The characteristic preferably changes relatively slowly, over a period of several seconds, for example.

In one preferred form, the indicator is a microencapsulated chemical indicator which is directly applied on the disc or on a sheet bonded to the surface of the disc. The indicator is activated to cause the indication when the discs are moved with respect to each other, at lid removal, so as to rupture the microcapsules and activate the chemical. In a modification of this, the indicator comprises a first chemical which is either coated or microencapsulated on a disc surface or on a sheet bonded to that surface, and the indicator is activated by or in the presence of another chemical or catalyst which is also microencapsulated on the disc, as the rupturing of the microcapsules brings the chemical and catalyst or the two chemicals together to cause the indication.

One cf the discs may be deformed in shape to assure that the microcapsules will be ruptured when the container lid is removed from the container, but will not be ruptured when the lid is initially placed on the container. For example, the one disc might have flaps, vanes or blades on it which are normally deflected toward the microcapsule carrying surface of the other disc. The flaps or blades are oriented so that in the rotation of the lid, for example in the clockwise direction, for placing the lid on the container, the flaps, vanes or blades simply slide easily over the surface of the other disc. However, the flaps are oriented so that upon reverse rotation of the lid for removing it from the container, the flaps now dig into the surface of the other disc and rupture microcapsules there, assuring that the indication occurs upon initial removal of the lid from the container.

The foregoing arrangement would not be effective with respect to a snap-on lid, but other means of activating an indicator between the two discs of the indicator can be envisioned for snap-on type lids. Many snap-on type lids now include a feature intended to prevent unauthorized opening of the lid by a child. Where lid opening requires rotation of the lid to align a key on the lid with a keyway on the container, that rotation may also activate the indicator, as described above.

The upper and lower discs of the indicator may be actual discs, or annular rings, or combinations of these, so long as they have sufficient surface area at appropriate locations for the upper disc to be adhered inside the lid, the lower disc to be adhered to the neck of the container and the two discs to be initially separably secured together.

In a further embodiment, the flaps, vanes or blades can be formed directly in the lid so that only a lower disc is used. The lid effectively acts as the upper disc in the various actions discussed above. The lower disc then contains the microencapsulated indicator. Conversely, the single disc can support the vanes, flaps or blades and the microencapsulated substance may be directly formed on the lid of the container.

In a variant of this just described embodiment, the lid is comprised of a material which permits observation through the lid of the underside of the lid and the disc beneath the lid. For example, the lid may be translucent or transparent. As soon as the lid is moved with respect to the container to initiate removal, even if the lid is never completely removed, the indicator at the lid or disc is activated and this can be observed through the lid.

To assure that the flaps, vanes and especially the blades rub over the indicator, the indicator may have an initial depression in which the blade nests, and when the lid is removed, the blade is pulled out of that depression so that it presses upon and scrapes hard over the indicator.

In place of the flaps or vanes or blades, the means which rubs over the indicator may comprise a series of projections formed or molded into the underside of the lid. The projections may be in a plurality of radial arrays or in any other desirable configuration for activating the indicator disposed beneath the lid on the neck of the container.

Where the means for activating indicator is defined in the underside of the lid, the single disc on which the indicator is carried is viewed through the lid. Ihat disc may be a multilayer laminate, including as its top layer opposite the activating means under the lid, a paper which carries microencapsulated ink. As the lid is being removed, the projections under the lid rub the paper, rupture the microcapsules, and cause the ink to be visible. The bottom layer of the laminate is a support of cardboard, plastic or the like, and would be seated on the neck of the container. Sandwiched between the upper paper layer and the lower support layer is a thin layer of foam material. The layer of foam material serves a number of functions. It compensates for manufacturing tolerances and variations among containers and their necks, and the lids and the projections under the lids. Thus, a lid whose top is slightly tilted with respect to a container or a neck whose top edge is slightly tilted with respect to a lid will not interfere with proper operation of the tamper indicator. One additional benefit is that a foam layer will slightly bias the paper layer against the projections under the lid. The contents of a full container, especially if it is plugged with cotton or other container filler, will also urge the disc up against the projections.

In yet another embodiment, the lower disc is not a disc at all, but is instead an annular band around the periphery of the neck of the container. Then the interior of the cover carries a respective band or is formed to coact with the annular band for activating the indicator when the cover is removed from the neck of the container. The band in the cover may contain the microencapsulated substance. This embodiment may also be adapted with the see-through variant of the previous embodiment.

Various indicators may be used to be activated by the removal of or tampering with the lid.

For example, an indicator, such as phenolphthalene, changes color upon a change in its pH. The phenolphthalene is either coated on the surface of one of the discs or is microencapsulated on one of the discs. Citric acid or comparable acid is also microencapsulated on one of the discs. Opening of the container lid ruptures the microcapsules of citric acid, changes the pH of the phenolphthalene and produces a color change on the disc. Other examples of appropriate chemicals that may be used in the indicator can be found in U.S. Pat. No. 3,896,965.

Another type of chemical useful for the indicator is a colorless dye, called a color blocking dye or a leuco dye, which is colorless, but instantly exhibits color when it is exposed to air. This dye is microencapsulated and is exposed to air when the microcapsules are broken. Such a dye is available, for example, from Appleton Papers Inc. of Appleton, Wisconsin. In addition, NCR Paper SC White 190, made by Appleton Papers Inc. is a paper coated with such a leuco dye. The disc to be provided with an indicator is covered with such coated paper to serve as the indicator. So that a user could observe that a lid provided with a leuco dye or other rapid change indicator has been tampered with, the lid may be of a material permitting viewing of the indicator through the lid, whereby the user will observe the activated indicator through the lid and be able to infer that removal of the lid has occurred or at least that it has been attempted.

In yet another arrangement, the indicator might be a mixture of dry foam crystals (e.g. toluene di-isocyanate or TDI crystals) interspersed with microcapsules of water, the mixture being located under a thin transparent film (e.g., a PVC film). When the lid is removed, the flaps, vanes or blades rupture the microcapsules, causing the water to react with the TDI crystals. This causes the crystals to foam and swell and also change color thereby providing an indication that the lid has been removed.

Since the TDI foam is toxic, it must not mix with the contents of the container. This is prevented by a transparent PVC film encapsulating the foam. The PVC film also limits the degree of physical expansion of the foam. By way of example, the film may initially rise 1/32" from the surface of the disc before the microcapsules are broken. Once the capsules are broken, the TDI crystals foam and expand within the film casing. This causes the film to expand to, for example, a distance of ½" above the surface of the disc. One advantage of this embodiment of the invention is that the indicator has a tactile, as well as a visual, human perceptible characteristic which changes upon activation. This will, for example, enable visually handicapped persons to determine if the lid has just been removed for the first time by placing their fingers over the transparent film and feeling the film rise.

One benefit of the lid itself or cover inserts or discs or bands of the invention is that each can be produced as a separate component and supplied to a party who loads the container and then closes the lid or cover over the container. The invention avoids the need for an additional step after loading of the container, such as sealing the lid or the entire container, to provide an indication of whether a container has been opened. Typical container lids already have a separate disc or band in them, frequently of cardboard, waxed cardboard, or even plastic, which provides a seal against the ambient environment between the lid and the open neck of the container. The insert, disc or band of the invention might be substituted for such a disc or band, whereby a party who loads a container will simply substitute one type of seal with the present invention which serves as the same type of seal and also serves as a tamper visible indicator.

The foregoing and other objects and features of the invention will become more apparent from the following description and accompanying drawings of various embodiments of the invention.

DESCRIPTION OF THE DRAWING FIGURES

FIG. 8 is a detailed cross-sectional view illustrating the interaction between a flap of the top disc and the microencapsulated indicator of the bottom disc of the insert of FIG. 7;

FIGS. 9 and 10 are detailed cross-sectional views of before and after conditions of an alternative indicator for the insert of FIG. 7;

FIG. 11 is an elevational cross-sectional view of a container adapted with a third embodiment of the present invention;

FIG. 16 is an exploded perspective view of a snap-on lid according to a sixth embodiment of the invention, at an initial orientation;

FIG. 17 is the same type of view of the sixth embodiment with the lid rotated from its initial orientation;

FIG. 18 is an elevational cross-sectional view of a container with a snap-on lid of the sixth embodiment;

FIG. 19 is also an elevational cross-sectional view of a container with a screw-on version of the lid of the sixth embodiment.

DESCRIPTION OF THE PREFERRED EMBODIMENTS

Figure 1:
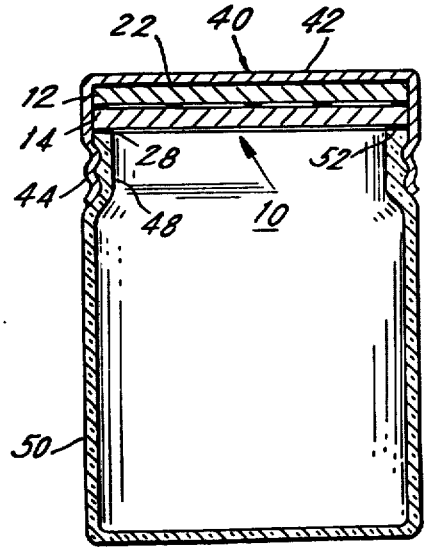
FIG. 1 is an elevational cross-sectional view of a container closed by a lid adapted with a first embodiment of the insert of the invention.
Figure 2:
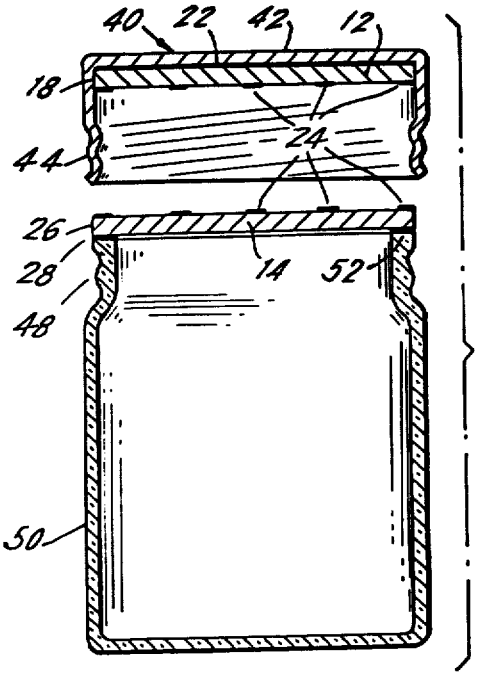
FIG. 2 shows that container after the lid has been removed.
Figure 4:
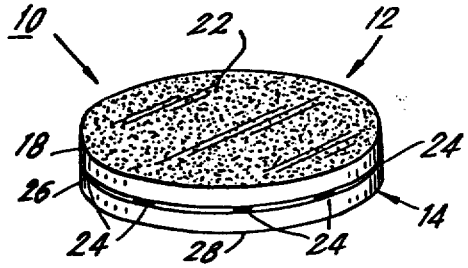
FIG. 4 is a top perspective view of the lid insert.
Figure 5:
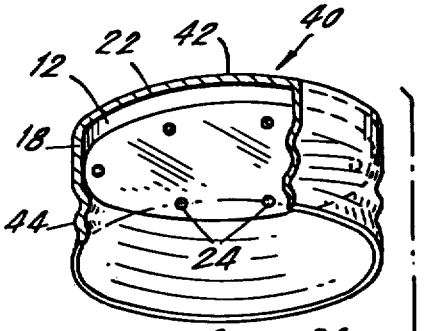
FIG. 5 is a bottom perspective view thereof.
Figure 5:
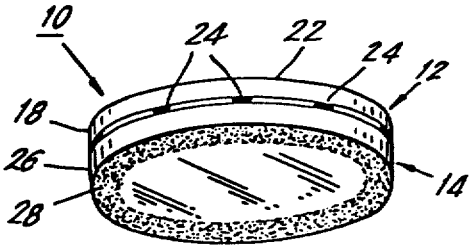
Figure 3:
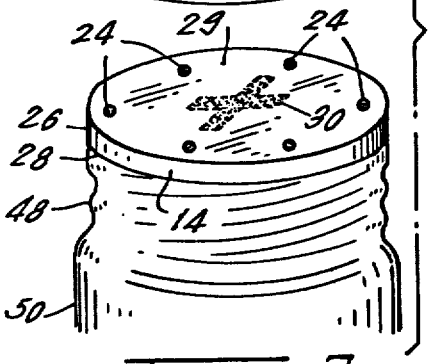
FIG. 3 is an elevational perspective view of the container after the lid has been removed.

FIGS. 1–3 illustrate the lid insert 10 of a first embodiment of the present invention. Insert 10 comprises a pair of superposed discs, including an upper disc 12 and a lower disc 14. Each disc 12 comprises a fairly stiff, thin, flat layer, 18 and 26, respectively, of, for example, waxed cardboard, or polyethylene plastic or plastic known by the trademark MYLAR. The upper surface of the upper disc layer 18 is covered with an adhesive layer 22 for enabling the lid insert 10 to be adhered inside the lid 40 of a container. The lower surface of the upper disc layer 18 carries an annular array of spots of adhesive material 24, whose primary characteristic is that it holds the upper and lower discs 12 and 14 together, but supplies less adhesive securing force than the adhesive 22 on the top of the upper disc layer 18. The lower surface of the lower disc layer 26 carries an annular ring 28 of adhesive which is adapted to adhere to the top edge of the neck of a container. The area covered by the adhesive 28 is great enough that the securing force of the adhesive layer 28 is greater than the securing force of the adhesive spots 24, whereby the adhesive spots 24 will shear early enough to permit the discs 12 and 14 to separate before the lower disc 14 will lift off the neck of the container.

The upper surface 29 of the lower disc layer 26 has an indicator chemical coated on it in a pattern at 30. The chemical selected is of a type which, when exposed to light and/or air, or to another environmental condition, is adapted to change its characteristic, e.g. its color darkens, and such change occurs over a period of time, such as several seconds. This enables a user to observe the change and thereby infer if he is the first to cause the two discs to separate.

The lid insert 10 is initially installed inside the lid 40 and the adhesive layer 22 is applied against the inside of the top 42 of the lid. The illustrated lid 40 of FIGS. 1–3 is one that includes a screw threaded skirt 44 for being screwed onto the exterior of the threaded open neck 48 of a container 50. With reference to FIG. 1, when the lid 40 is screwed onto the screw-threaded neck 48 of the container 50, eventually the adhesive ring 28 beneath the lower disc layer 26 seats against and adheres to the upper edge 52 of the neck 48 of the container. With reference to FIG. 2, when the lid 40 is removed from the container 50, the upper disc 12 stays inside the lid 40 while the lower disc 14 stays on top of the container 50. The indicator 30 is exposed and is activated to change color. The color change gives the user an indication that the container lid has just been removed from the container for the first time.

The indicator 30 might be an ink, possibly microencapsulated, which changes color gradually upon exposure to air, light or other ambient condition. The unscrewing of the lid or the lifting off of the lid of a simple snap on and off lid will expose the ink and upon the exposure of the ink to light, air, etc., the indication will change. If microcapsules are used, the capsules may be adhered to both of the facing surfaces of the two discs, whereby sepration of the discs breaks the capsules. This will expose the substance in the capsules causing them to change their characteristic.

Figure 6:
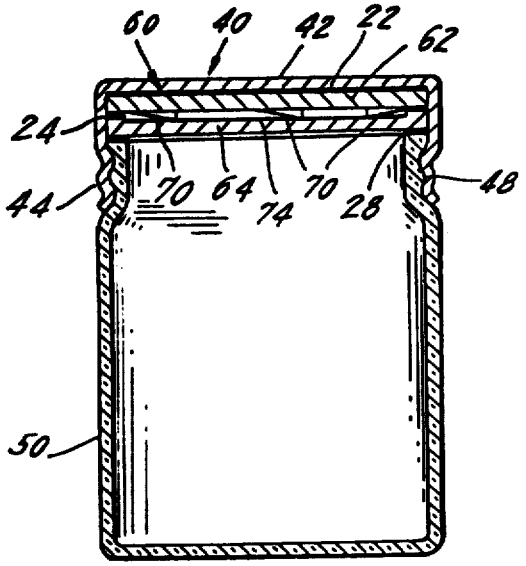
FIG. 6 is an elevational cross-sectional view of a container closed by a lid adapted with a second embodiment of the present invention.
Figure 7:
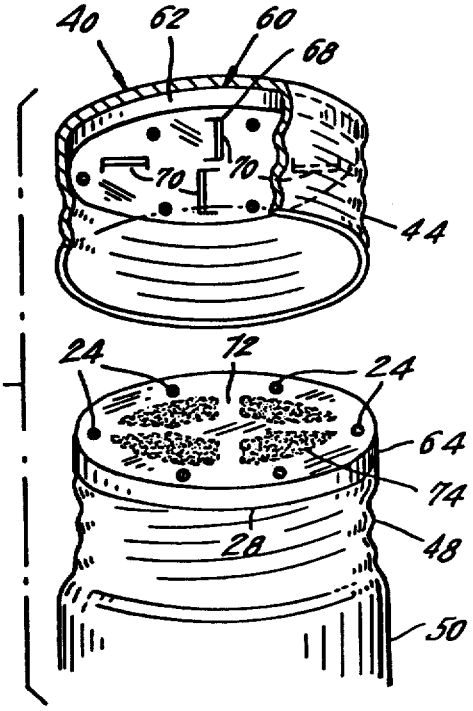
FIG. 7 is the same type of view as FIG. 3 of the second embodiment.

An alternate form of lid insert and indicator, particularly useful for a screw top container and for a lid which must be rotated before removal, is shown in FIGS. 6 and 7. This insert 60 comprises the upper disc 62 and the lower disc 64. The two discs are secured together by adhesive spots 24 between the discs 62 and 64. The upper disc 62 has a plurality of flaps or vanes 70 extending from it and spaced slightly radially inwardly from its periphery. The flaps are normally spring biased to project downwardly toward the lower disc 64.

One possible structure of the flap 70 is illustrated in FIG. 8. In this embodiment, if the upper disc 62 is formed of a thin cardboard material or a plastic material, such as a material sold under the trademark MYLAR or a polyethylene, the flaps 70 may be formed by stamping a cut-out 68 in the disc 62 and by bending the flap 70 as shown. With a plastic material disc, it can be molded or stamped out in a heated die, and the bent flaps can be formed during disc formation. The elasticity of the disc material will cause the lower end 71 of the flap 70 to be biased downwardly toward the lower disc 64. In the preferred embodiment, the lower edge 71 of the flap 70 normally rests against the lower disc 64 at a position in between two adjacent indicator strips 74. This ensures that flap 70 will not inadvertently rupture the microcapsules in the indicator strips 74 during normal handling of the container. When the lid 40 is initially screwed on to the container, the upper and lower discs 62,64 will be held together by adhesive 24 and there will be no relative movement between the discs. Accordingly, the flaps 70 do not break the microcapsules. With the lid tightened onto the container, the adhesive 28 beneath disc 64 adheres the disc to the container neck. When the lid 40 is removed from the container 50, the bottom disc 64 will remain on the container 50 and there will be relative movement between the top and bottom discs 62,64. As a result, the flaps 70 will break the microcapsules contained in indicator strips 74 due to the downward bias of the flaps 70.

Figure 8A:
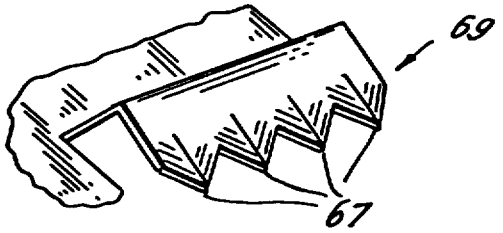
FIG. 8A is an enlarged fragmentary perspective view of an alternate form of flap useful for this embodiment.

In FIG. 8A, the flap 67 has a free edge that is not merely straight. Instead, the free edge is serrated at serrations 69, which extend from the free edge of the flap. The serrations each narrow to a pointed tip. In addition, the serrations are not merely in the plane of the flap, but instead, each one is deformed to have a V-shaped profile, giving each serration a scoop-like shape. Because the serrations are not flat in the plane of the flap, they are rigidified and thereby rigidify the free edge of the flap and also rigidify the entire length of the flap. Particularly when the flaps are formed during initial formation of the disc from which they extend, as by stamping or heat formation, and where the disc is of a resilient plastic material, which is formed and defined during stamping, the serrations can be easily formed. As noted above, the serrations stiffen the flap against flopping over when the flap rubs the indicator beneath it. Also, if the indicator material is microencapsulated, it will be pulled up by the serrations and each serration will then define a wider swath across the indicator.

A third embodiment of the invention is illustrated in FIG. 11. By way of example, this embodiment is shown in connection with a nasal spray squeeze container 76 having a thin elongate neck 78 that terminates in a narrow spray opening and which neck includes external threads 80 which mate with cooperating internal threads 82 formed in a suitable cap 83. In this embodiment, the indicator is carried on a lid insert in the form of a tape or band 84 that is adhered to and wrapped around the base of the neck 78 of the container 76. The tape 84 may include a microencapsulated indicator of the type used in indicator 74. The indicator may be another microcapsule containing material which is simply coated on the neck of the container. To activate the indicator at the neck of the container, a plurality of flaps 86 are formed, i.e. molded, inside the cap 83 near its open bottom end. The flaps are biased inward toward the neck and so structured that they will freely flex radially outward when the cap 83 is screwed onto the neck 78. Like the flaps 70, the flaps 86 are oriented to trail to the rear of their line of attachment inside the cap when the cap is tightened. When the cap 83 is screwed off the neck 78, the flaps 86 now lead their line of attachment inside the cap. Because the flaps are biased radially inward, the free edges of the flaps rub over and rupture the microcapsules to activate the indicator in the tape 84. Note that in this embodiment, the the cap 83, 86 performs the function of one of the two discs of the first two embodiments.

Figure 12:
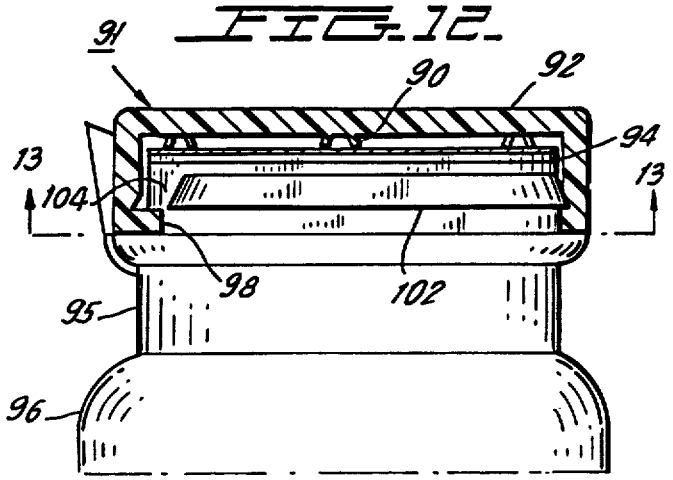
FIG. 12 is an elevational cross-sectional view of a container and lid combination adapted with a fourth embodiment of the invention.
Figure 13:
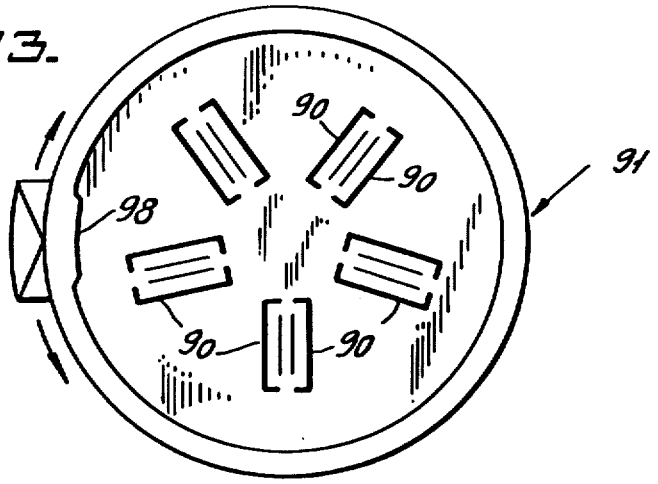
FIG. 13 is a bottom view of the lid of the fourth embodiment.

In a fourth embodiment of the invention shown in FIGS. 12 and 13, the upper disc 12, 62 can be omitted and the flaps 90, corresponding to the flaps 70, are formed directly in the top 92 of the lid 91. The bottom disc 94 may still take the form illustrated in FIG. 7 but the adhesive spots 24 are omitted. This embodiment is particularly useful with respect to a snap top container where the lid 91 is snapped onto the neck 95 of the container 96. For this purpose, the lid 91 includes an inwardly directed locking key element 98 which is intended to be snapped over the annular collar 102 defined around the neck 95 of the container. The cooperation of the key 98 and the collar 102 locks the lid 91 securely in place over the open neck of the container. As is conventional with these containers, the collar 102 has a break 104 which defines a keyway. The lid is locked in place with the key 98 and keyway 104 misaligned. When the lid 91 is rotated so that the key 98 is lined up with the keyway 104, the lid can be raised off the neck of the container.

The lid must be rotated to release the locking. It is desirable for the rotation of the lid in either direction to bring the key and keyway to their unlocking position and also for this rotation, which is a prelude to removal of the lid, to also activate the indicator. Since the direction of rotation of the lid 91 prior to its separation from the container cannot be predicted, the top 92 of the lid is punched out at a plurality of locations around its surface for defining respective pairs of the flaps 90 which, as shown in FIG. 12, all extend down at an incline toward the surface of the disc 94. Rotation of the lid 91 in either direction causes at least one of each pair of flaps 90 to be moved with its free edge forward to rub over the upper surface of the disc 94 and activate the indicator strip there. For fullest coverage of the upper surface of the indicator disc 94 for maximum indication, a relatively large plurality of pairs of the flaps 90 are provided, whereby even if there is only a small amount of rotation to bring the key 98 and keyway 104 into alignment, nonetheless, the indicator will be activated in many areas over the disc 94, for maximum visual indication.

In common with the third embodiment, this embodiment uses a single disc, and the lid 91 performs the function of the upper disc in a two-disc embodiment. What is important in both this embodiment and the previous embodiment is that the neck of the container carries one element of the indicator and the lid carries the other element of the indicator, and it is the separation of the lid from the neck of the container which activates the indicator, e.g. by one of the neck of the container or the lid, or both, carrying an indicator and the other carrying means for activating the indicator upon separation, or by the mere act of separation of the lid from the container activating the indicator.

One preferred form of indicator chemical for inclusion in microcapsules comprises initially separated phenolphthalene and acid, e.g. citric acid. Separate microcapsules of both of these may be mixed together to serve as the indicator. Alternatively, the phenolphthalene may be coated directly on the surface of one disc in dry form while the microcapsules of liquid contain only the acid, or vice-versa as to which component will be in liquid form and which in dry form. In any event, it is the opening of the lid which ruptures the microcapsules, causing the pH of the liquid solution which includes the acid and the phenolphthalene to change, and leads to a color change of the indicator. In this particular case, the rupturing of the microcapsules causes the mixing together of two previously separated chemicals which, when they are mixed together, cause a visible color change.

An alternative form of indicator strip 74 is illustrated in FIGS. 9 and 10. In this embodiment, a mixture 77 of dry foam crystals, for example, toluene di-isocyanate or TDI crystals, interspersed with microcapsules of water, are located under a thin transparent film 79 of, for example, polyvinyl chloride or PVC. As TDI crystals include possibly toxic material, the film 79 prevents exposure of the user of the lid and container and of the contents of the container to this toxic material. When the lid 40 is removed from the container 50, the flap 70 runs over the thin film 79 and ruptures the microcapsules of water contained in the mixture 77. This causes the TDI crystals to foam and expand in the manner illustrated in FIG. 10. The color of the foam also changes. As clearly shown by a comparison of FIGS. 9 and 10, the height of the thin film 79 above the disc 64 increases substantially, from 1/32" to ½" for example, once the microcapsules have been ruptured and the foam develops. This indicator enlargement is advantageous since it provides a tactile, as well as a visual, indication that the indicator has been activated. For example, this would enable blind persons to infer if the lid has been removed for the first time by placing their fingers over the transparent film 79 and feeling the film rise.

Figure 14:
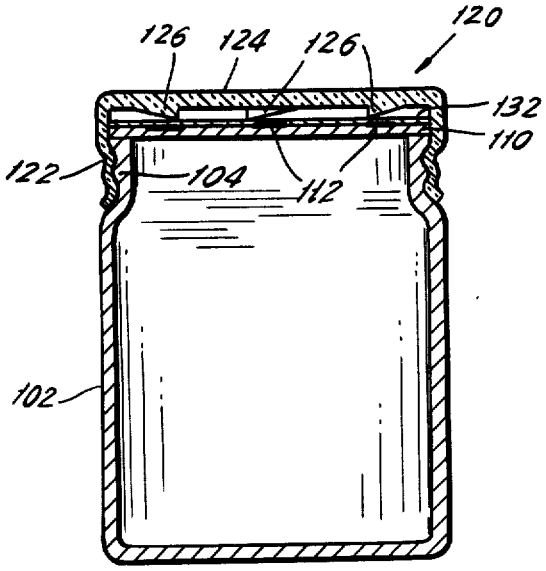
FIG. 14 is an elevational cross-sectional view of a container adapted with a fifth embodiment of the present invention.
Figure 15:
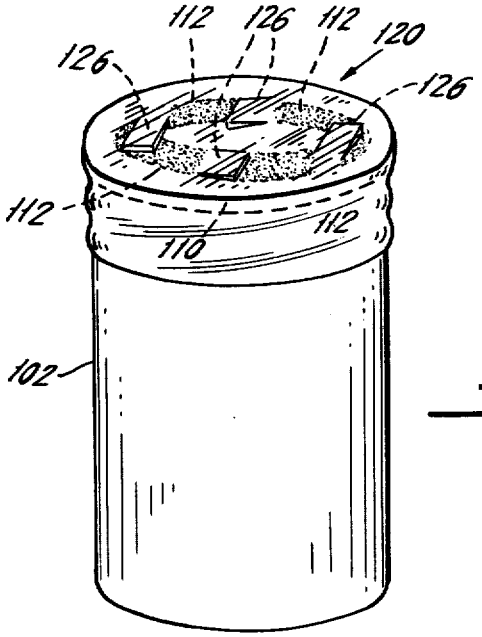
FIG. 15 is a perspective view of the fifth embodiment.

Yet another embodiment incorporating concepts from the embodiment of FIGS. 6 and 7 and from the embodiment of FIGS. 12 and 13 is shown in FIGS. 14 and 15. The container 102 is the same type as container 50, including screw threads 104 at its neck. A disc-shaped insert 110 is seated on and is normally adhered to the neck of the container at the open end of the neck. The disc 110, for example, has the characteristics of the above-described disc 64, and includes thereon the indicator strips 112, which are analogous to the indicator strips 74.

The distinctive feature of this embodiment is the lid 120, which is a screw-on lid with a depending skirt 122 which is internally screw threaded to mate with the threads 104 of the container 102. The underside of the top 124 of the lid 120 is provided with a plurality of downwardly biased flaps 126 analogous to the flaps 70 or 69 or 90, described above. In a situation where the lid 120 could be applied to the container without being screwed on, even though it must be rotated or unscrewed for removal, in place of the flaps 126, rigid projections or blades may be defined at the underside of the top 124, for activating the indicator, as described below.

The lid 120 is preferably an integrally molded unit of plastic material, or it may even be glass, and the integrally molded lid is smooth on the top and includes the flaps 126 on its underside. With the flaps 126 biased down toward the disc 110, upon rotation of the lid 120 to remove it from the container, the flaps rub over the indicator strips 112 and activates the indicator, as described with respect to indicator strips 74. In this embodiment, as in the embodiment of FIG. 12, the lid 120 itself performs the function of the upper disc 62 in the embodiment of FIG. 6, eliminating the need for a second disc as in that previous embodiment.

In this embodiment, the entire lid 120, or at least the portion of the top thereof overlying the indicator strips 112, is comprised of material which permits viewing of the indicator strips 112 through the top of the lid. For example, light transmissive, transparent or translucent, plastic or glass, which is sufficiently light transmissive to enable the user of the container to observe whether the indicator strips 112 have been activated, even without the user having to first remove the lid 120 from the container 102. Therefore, even before the user acquires or purchases the container, he can see an indication from which he can infer whether the container lid has been tampered with and he could select a different container.

This embodiment is also useful in connection with an indicator which changes its human perceptible characteristic rapidly, that is, in less time than it requires for an authorized user to remove the lid, between initiation of lid removal and final lid removal. With an indicator that may change too rapidly for a user to see the indication change after he has removed the lid, this embodiment is quite valuable.

One convenient type of indicator which is currently available is known as a color blocking dye or a leuco dye. It is available from Appleton Papers Inc. of Appleton, Wisconsin. In one form, it is supplied as a sheet of paper. Then the indicator strips 112 would be pieces of this paper cut to the desired shape. This dye is useful in connection with this embodiment because it changes from being colorless to having a clearly visible color when it is exposed to air. Furthermore, this dye is readily microencapsulated, whereby it can be readily activated by rubbing. Finally, it has long term stability when microencapsulated, so that a tamper indicating means using this dye will have a long shelf life, preferably at least as long as the shelf life of the container on which the indicator is used. A leuco dye changes color almost instantly when it is exposed to air. It would not be useful for the indicator strips of the earlier embodiments where the indicator strips cannot be viewed until the lid is completely removed. Simple loosening of the lid in those other embodiments would activate the indicator strips, and the leuco dye would change color, so that by the time the lid is removed, the indicator strip would have changed color. A user would not then be able to infer whether the leuco dye indicator strip had just changed color or whether it had changed color due to previous tampering with the lid. With the present embodiment, in contrast, the indicator strips 112 are visible through the lid, even before removal of the lid has been initiated. The user can watch the indicator strips as he removes the lid, and can watch the substantially instantaneous change of color of the indicator strips as he removes the lid, from which he could infer that no previous attempt has been made to remove the lid.

The indicator strips 112 in the present embodiment, as well as the indicator strips in the other embodiments, may be fabricated using materials which are not approved for ingestion. Leuco dyes are not approved for ingestion. This is also true for TDI crystals. Use of such indicator strips might, therefore, not be correct in containers for items to be ingested. To overcome this problem, a separate, thin, protective sheet of transparent plastic material 132 is applied over the indicator disc 110 to cover over all of the indicator strips 112, or individual ones of the strips may have individual protective layers over them, whereby the material of the indicator strip will be completely encapsulated on the disc and could not be contacted directly by the person opening the container or be contacted by the contents of the container. Such covering over was described with respect to the TDI crystals of the embodiment of FIGS. 9 and 10. Where the indicator is activated in the presence of air, the protective layer 132 has a small amount of air captured beneath it, so that rupture of the microcapsules of the indicator would expose the indicator to air and cause the desired color change.

Although the indicator strips 112 are shown as simple annular segments, the indicator strips can be arranged in any desired pattern, so that words or symbols would be reproduced, as desired by the party who uses the lid and indicator on his containers.

The sixth embodiment of the invention is shown in FIGS. 16 and 17. As in the fifth embodiment of FIG. 14, the lid 146 of the sixth embodiment is transparent, so that the indicator can be viewed through the transparent top 148 of the lid 146. The lid 146 is a snap-on lid adapted for being snapped onto the neck 136 of the container 134, as in the fourth embodiment of FIG. 12. The lid 146 has a depending skirt 152 which depends down around the side of the neck 136 of the container and abuts the annular flange 154 on the neck.

The neck 136 of the container 134 carries an annular outwardly and downwardly inclined flange 138 which is interrupted over a short length segment at 142 to define a keyway for enabling removal of the lid 146 from the neck of the container. The flange 138 is inclined so that the lid 146 can be snapped into place, with the lip 157 and key 158 sliding down over the outwardly inclined flange 138 until they hook beneath that flange. The bottom of the flange 138 precludes removal of the lid. The lid has a relatively narrow, radially inwardly projecting, annular lip 156 at its bottom which defines a shallow groove 157 into which the flange 138 projects. At the lip 157, the lid has a radially inwardly projecting key 158 at one spot around its bottom edge, which projects radially inwardly sufficiently to hook securely under the bottom of the flange 138. This blocks removal of the lid 146 from the container. With the lid rotated so that the key 158 lines up with the keyway 142, the key 158 can be moved up through the keyway 142 and this permits the lid to be bent upwardly, starting at the location of the key 158 and this enables removal of the lid 146 from the neck 136.

Integrally molded beneath the underside of the top of the lid 148 is the two section, rigid, triangular cross-section blade 164 and 166. The blade is interrupted at the center of the lid between the two sections 164, 166. The blade is intended to be rubbed over the indicator, described below, for activating the indicator.

The indicator according to this embodiment is on the disc 170, which in this embodiment is of a height slightly greater than the height of the blades 164, 166. The disc is shaped to nest inside the skirt 152 of the lid 146 against the underside of the top 148 of the lid. To enable the lid to be pushed down tightly over the disc 170 despite the rigid projecting blade 164, 166, the top side of the disc 170 is provided with two triangular cross-section depressions 172, 174 of mating shape and size and placement to the corresponding sections blades 164 and 166, whereby with the lid placed over the disc, at a predetermined orientation, the blade sections 164, 166 nest in the respective depressions 172, 174. For example, it is contemplated that the depressions 172 and 174 will be oriented 90° from the rotative position of the lid at which the key 158 will be aligned with the keyway 142, whereby the lid will have to be rotated 90° from its installed position to remove the lid.

The top surface of the disc 170 carries two almost semicircular indicator panels 176, 178, in the form of paper treated with microencapsulated leuco dye, for example, as in the indicator strips 112 of FIG. 15. As appropriate, the layer of leuco dye is covered by an additional layer 179 of a clear plastic thin film which encloses the leuco dye layer so that the user of the container and the contents of the container are not exposed to the leuco dye itself.

Upon rotation of the lid 146 through 90° to an orientation aligning the key 158 and the keyway 142, that is, to the orientation shown in FIG. 17, for example, the blade sections 164 and 166 ride up out of the depressions 172 and 174 and the blade sections 164, 166 press down hard upon the top of the disc 170 and the indicator panels 176 and 178, deforming the disc and breaking the microcapsules of leuco dye, providing the activated areas 182 and 184 of the indicator panels 176 and 178. The activated areas 182 and 184 are shown as crescent shaped, consistent with the shape of the corresponding blade sections 164 and 166. The areas 182 and 184 may merely be color panels or they may be shaped or provided with microencapsulated coating at appropriate areas to define a particular message on the indicator areas, for example, the container contents, manufacturer's trademark or symbol, the condition of the container, such as the word "safe", etc.

FIG. 19 shows an alternate for the sixth embodiment of FIG. 18 with a screw-on lid, rather than a snap-on lid. The container 192 is provided with a neck 194 which is externally screw threaded to cooperate with the internally screw threaded skirt 196 of the transparent lid 200. A disc 170 is disposed atop the neck 194 and beneath the lid 200. The lid 200 includes the blade sections 202 which correspond with the blade sections 164, 166 and are received in the grooves 172, 174 of the disc. In this embodiment, the disc 170 is initially installed under the lid 200, and then the lid is tightened over the neck 194 of the container. As the lid 200 is screwed on, the disc 170 rotates together with the lid and there is no relative motion of the lid with respect to the disc. Eventually, the disc 170 is tightened down on the neck 194. Further rotation of the lid 200 is then resisted by the engagement between the disc 170 and the neck 194. The underside of the disc 170 may be provided with adhesive material to assure that once the disc 170 engages the neck 194, further rotation of the disc 170 is prohibited. The usually automatic means (not shown) used for tightening the lid 200 will be adapted to apply only a preselected tightening force which will assure that the lid 200 will not be tightened so far that the blade sections 202 will ride out of the depressions 172, 174 and thereby prematurely rub across the disc 170 and activate the indicators. Instead, further tightening of the lid 200 will be prohibited when rotation of the disc is inhibited by its engagement with the container neck. Now that the disc adheres to the top of the container neck, when manual force is applied to open the lid 200, the disc 170 is prohibited from correspondingly rotating along with the lid and the lid 200 will rotate with respect to the disc 170, causing the blade sections 202 to rub over the indicator panels on the disc and activating the indicators, as in FIG. 17.

Figure 20:
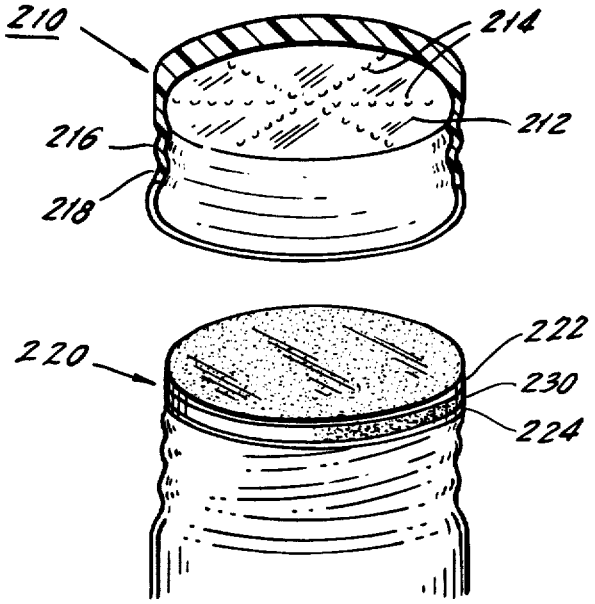
FIG. 20 is an exploded perspective view of a screw-on lid according to a seventh embodiment of the invention.

FIG. 20 shows a seventh embodiment, which is particularly useful with a screw-on lid, but which is also useful with a snap-on lid that must be rotated for removal from a container, such as the screw-on lid of FIG. 19 or the snap-on lid of FIG. 18. The screw-on lid 210 is molded of transparent or at least light transmitting plastic material and might be the same as the material of the lids 146 or 200 of FIGS. 18 and 19. Its underside carries or preferably has molded into it a plurality of radially oriented arrays 214 of short length projections, with six equally spaced arrays 214 illustrated. These projections are long enough and sharp enough to scratch an indicator surface supported on the container neck. With six equally spaced radial arrays of projections, and with the projections in each of the radial arrays being at different respective positions along the respective radii of the disc, when the lid is rotated over a short arcuate distance to effect removal of the lid, or even over as much as 180°, each section of the indicator beneath the lid will be rubbed by a number of the projections in various radial arrays, fully activating the indicator. The peripheral skirt 216 of the lid is screw threaded at 218, as in the other screw threaded lid embodiments.

The arrays 214 of projections molded beneath the top 212 of the lid 210 are specifically illustrated for use in connection with this embodiment. That design of projections may be used for other embodiments disclosed herein, where the lid carries the indicator activating projections, or even in those embodiments where a disc is inserted into the top of the lid, because the projections on that disc may be arranged in the arrays illustrated in FIG. 20.

The disc 220 of this embodiment is a composite or laminate comprised of three layers. The thickness of the layers of the disc 220 has been exaggerated for illustrative purposes. The disc 220 and its various layers will be considerably thinner, in practice, to be used in a typical container lid. The disc 220 includes the uppermost indicator layer 222 which is, like the indicator 176, 178, comprised of a paper layer which carries microencapsulated ink that is activated upon initial exposure to air. In FIG. 20, the entire paper layer 222 is covered with the microcapsules. Clearly, however, the microcapsules might be in a pattern on the paper layer 222 to provide any desired indication, from a trademark to a message relating to the container, its contents or its safety for use, etc. The bottom layer 224 of the laminate is a layer of cardboard which supports the entire disc 220, gives it some rigidity and which is the layer that sits on the top edge of the neck of the container.

A significant feature of this embodiment is the thin intermediate layer 230 of a conventional, small pore, plastic foam material, which is thick enough and deformable enough that it will compensate for dimensional tolerances arising in the fabrication of the containers, the container necks, the lids, the peripheral skirts of the lids and the projections beneath the lids, such that the paper indicator layer 222 of every disc 220 will be held in the correct operative position with respect to the projections 214 beneath every lid. For example, the foam layer 230 permits the paper layer 222 to tilt with respect to the cardboard layer 224 beneath, if required, or permits the paper layer to have a slight depression or upraised ridge, as contrasted with the flat cardboard layer 224. Furthermore, the foam layer 230 provides a minor bias of the paper layer 222 toward the projections 214 to assure that the projection 214 will surely and firmly rub over the indicators on the paper layer 222.

The discs 12, 14 or 62, 64, 110 or 170 and the disc layer 224 may be comprised of wax coated cardboard. Other suitable materials will be apparent to one skilled in the art, e.g. coated paper, uncoated paper or cardboard or thin plastic discs. Furthermore, the discs need not be solid discs, but one or both may be annuli, so long as the annuli have sufficient radial thickness to adhere as required and to carry the indicators thereon, as required. The type of indicator that may be used is a matter of choice, so long as its characteristic is to provide an indication when the discs df the indicator are separated for the first time.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A container lid insert for indicating that a container lid has been removed from the opening into a container, the lid insert comprising:

an upper disc-like element and a lower disc-like element; each element having a respective upper and lower surface; the lower surface of the upper element being superposed over the upper surface of the lower element; first securement means for securing the upper and lower elements superposed;

second securement means at the upper surface of the upper element for securing the upper element in the container lid; third securement means at the lower surface of the lower element and positioned for engaging the container around the opening which is covered by the lid and for securing the lower element to the container there;

the second and third securement means being adapted to exert greater securing force on the lid and container, respectively, than the first securement means is adapted to exert between the upper and lower elements, whereby with the upper element secured to the lid at the second securement means and the lower element secured to the container at the third securement means, upon separation of the lid from the container upon which the lid is positioned, the first securement means is adapted to permit the upper and lower elements to become separated at the superposed surfaces thereof;

indication means adapted to respond to the separation of the upper and lower elements and the indication means being located between the upper and lower elements and being adapted to provide its indication upon the separation of the upper and lower elements.

2. In combination, a container lid and the lid insert of claim 1, wherein the lid comprises a top and a depending skirt depending from the top, and the skirt being adapted to extend down past the opening into a container on which the lid is to be placed; the lid insert being installed inside the lid skirt with the upper surface of the upper element of the insert being lodged against the top of the lid.

3. In combination, the combination of claim 2 and a container having an opening into it, which opening is surrounded and defined by a neck of the container, and the neck having a top edge; the lid being removably placeable over the container opening with the skirt of the lid extending down outside the neck of the container, and the lid skirt being shaped such that with the lid tightened onto the container neck, the third securement means on the lower element lower surface contacts the top edge of the container neck for securing the lower element to the container neck.

4. The lid insert of claim 1, wherein the second and third securement means comprise adhesive for adhering the upper and lower elements respectively to the lid and the container.

5. The lid insert of claim 1, wherein the upper and lower elements each comprise a flat disc.

6. The lid insert of claim 1, wherein the indication means comprises an indicator at at least one of the superposed upper element lower surface and lower element upper surface, and the indicator being activated for providing its indication upon the separation of the elements.

7. The lid insert of claim 6, wherein the indicator is a visible indicator.

8. The lid insert of claim 6, wherein one of the superposed surfaces supports an indicator which is activated by rubbing of the other element across the indicator, and the other element being superposed on the one element for being rubbed across the indicator upon separation of the elements, for activating the indicator.

9. The lid insert of claim 8, wherein the other element carries an activation member thereon which is normally biased toward the indicator during separation of the elements.

10. The lid insert of claim 9, wherein the activation member comprises a flap on the other element which is normally biased toward the indicator.

11. The lid insert of claim 10, wherein the other element is cut through to define the flap.

12. The lid insert of claim 10, wherein the flap is shaped and oriented to slide lightly over the indicator when the elements are moved in one direction, but the flap being biased to attempt to resist reverse direction motion of the elements with respect to each other, and the attempted resistance against reverse direction rotation causing activation of the indicator.

13. The lid insert of claim 6, wherein the indicator comprises a microencapsulated liquid, and the microcapsules of liquid are placed for being broken upon separation of the elements.

14. The lid insert of claim 1, wherein the indication means responds to the separation of the upper and lower elements by changing a human perceivable characteristic of the indicator means.

15. The lid insert of claim 14, wherein the indication means comprises:

a mixture of dry foam crystals and microcapsules filled with a liquid solution, the crystals foaming when the microcapsules rupture and the crystals and liquid mix.

16. The lid insert of claim 15, further comprising a thin film covering said mixture.

17. A container and lid for indicating that the lid thereof has been removed, comprising:

a container body;

a lid for the container body;

an indicator including a microencapsulated substance supported on one of the container body and the lid; and rupture means associated with the other of the container body and the lid for rupturing microcapsules which encapsulate the substance only when the lid is removed from the container body, the indicator responding to the rupturing of the microcapsules by changing a human perceivable characteristic of the indicator.

18. The container of claim 17 wherein the rupture means projects from the lid toward the indicator.

19. The container of claim 17, wherein the rupture means comprises a plurality of flaps formed on the other of the container body and the lid, the flaps being normally biased toward the microcapsules when the lid is placed on the container and the flaps pressing upon the indicator for rupturing the microcapsules as the lid is removed from the container.

20. The container of claim 19, wherein the flaps are formed on the lid.

21. The container of claim 17, wherein the rupture means comprises an inflexible blade formed in the other of the container body and the lid for pressing upon the indicator for rupturing the microcapsules as the lid is removed from the container.

22. The container of claim 21, wherein the blade is formed on the lid.

23. The container of claim 17, wherein the lid is of material permitting viewing beneath the lid so that the indicator is visible through the lid.

24. The container of claim 17, wherein the container has an opening with a neck defining the opening and the indicator is disposed around the neck of the container.

25. The container of claim 17, wherein said human perceivable characteristic is a tactile characteristic.

26. The container of claim 17, wherein said human perceivable characteristic is both a tactile and a visual characteristic.

27. The container of claim 17, wherein said human perceivable characteristic is a visual characteristic.

28. The container of claim 17, further comprising a thin film covering the indicator for containing it on the one of the container and the lid.

29. The container of claim 17, wherein the rupture means comprises a plurality of projections defined on the underside of the lid for rubbing the indicator and rupturing the microcapsules as the lid is removed from the container.

30. A container and lid for indicating that the lid thereof has been removed, comprising:

a container body having an opening into it surrounded and defined by a neck of the container;

a lid for the container neck; the lid having a top which covers the container opening at the neck;

a container insert for emplacement on the container neck; the insert having an upper surface facing toward the top of the lid; indication means at one of the top of the lid facing downward toward the insert and the upper surface of the insert facing toward the lid; and the indication means being adapted to respond to separation of the lid from the container neck and from the insert secured to the neck to be activated to provide an indication upon that separation.

31. The container of claim 30, wherein the container insert is initially inserted into the lid.

32. The container of claim 30, wherein the top of the lid is of material permitting viewing beneath the lid so that the indication means is visible through the top of the lid.

33. The container of claim 32, wherein the indication means is at the upper surface of the insert.

34. The container of claim 33, wherein the top of the lid carries means for activating the indication means in response to separation of the lid from the container.

35. The container of claim 34, wherein the indication means is adapted to be activated by being rubbed; the activating means is adapted for rubbing the indication means; the lid and the container body being adapted for the lid to be moved with respect to the container body to effect removal of the lid from the container.

36. The container of claim 35, wherein the lid is moved with respect to the container upon its removal, and the the insert remains with the container during lid removal, whereby the lid and the upper surface of the insert move with respect to each other for rubbing the indication means for activating it.

37. The container of claim 35, wherein the activating means comprises a rigid blade defined beneath the lid and shaped and sized for engaging and rubbing the indication means.

38. The container of claim 37, wherein the insert includes a depression formed in the upper surface thereof shaped and at a location that the lid may be installed over the insert with the blade resting in the depression, and the blade being so shaped with respect to the disc that upon relative rotation of the lid with respect to the insert, and the blade being rotated out of the depression in the insert, the blade pressing upon the insert for causing it to deflect and for rubbing the indication means for activating it.

39. The container of claim 35, wherein the indication means is adapted for being activated by being rubbed and the activating means comprises a flap biased toward the indication means for rubbing the indication means.

40. The container of claim 35, wherein the indication means comprises a microencapsulated liquid; the activating means comprises a plurality of projections defined on the underside of the lid for rubbing the indication means and rupturing the microcapsules of liquid as the lid is removed from the container.

41. The container of claim 40, wherein the indication means comprises a disc for being supported on the container body and carrying the microcapsules thereon.

42. The container of claim 41, wherein the disc has a plurality of layers including a bottom supporting layer for sitting on the neck of a container, a deformable top layer carrying the indicating means thereon and facing toward the lid and a cushion layer between the bottom and top layers, and the cushion layer being adapted to deform for adjusting for tolerances in the container and the lid fabrication.

43. The container of claim 42, wherein the cushion layer is of foam material.

44. The container of claim 30, wherein the indication means is adapted to be activated by being rubbed; rubbing means on the other of the lid and the insert for rubbing and activating the indication means; the lid and the container body being adapted for the lid to be moved with respect to the container body to effect removal of the lid from the container; the lid, which is moved with respect to the container upon its removal, and the upper surface of the insert, which remains with the container during lid removal, move with respect to each other for rubbing the indication means for activating it.

45. The container of claim 44, wherein the rubbing means comprises a flap biased toward the indication means.

46. The container of claim 45, wherein the flap is shaped and oriented to slide lightly over the indication means when the lid is moved in one direction with respect to the container, but the flap is biased to attempt to resist reverse direction motion of the lid with respect to the container, and the attempted resistance against reverse direction rotation rubs and causes activation of the indicator means.

47. The container of claim 44, wherein the indication means comprises a microencapsulated liquid, and the microcapsules of liquid are placed for being broken upon movement of the lid with respect to the container.

48. The lid insert of claim 30, wherein the indication means is activated by an environmental factor in the ambient environment of the indication means, to which the indication means is exposed upon separation of the elements.

49. The lid insert of claim 30, wherein the indication means comprises two separate components which, when mixed together, produce an indication responsive to that mixing, and the components are placed such that upon separation of the lid and the container, the components are mixed together.

50. The lid insert of claim 49, wherein at least one of the components comprises a microencapsulated liquid, and the microcapsules of liquid are placed for being broken upon separation of the lid and the container.

51. The container of claim 45, wherein the flap has a free edge which rubs the indication means, and the free edge comprises serrations.

52. The container of claim 51, wherein the serrations are pointed at their tips and are also folded in a scoop-like shape out of the plane of the flap from which the serrations extend.

* * * * *